US007226327B2

(12) United States Patent
Hallenstvedt et al.

(10) Patent No.: US 7,226,327 B2
(45) Date of Patent: Jun. 5, 2007

(54) OUTBOARD DRIVE FOR BOATS

(75) Inventors: Oddbjorn Hallenstvedt, Valskog (SE); Staffan Mansson, Myggenas (SE)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 11/306,327

(22) Filed: Dec. 22, 2005

(65) Prior Publication Data

US 2006/0166569 A1 Jul. 27, 2006

Related U.S. Application Data

(63) Continuation of application No. PCT/SE2004/000600, filed on Apr. 20, 2004, now abandoned.

(30) Foreign Application Priority Data

Jun. 23, 2003 (SE) ..... 0301802

(51) Int. Cl.
*B63H 20/32* (2006.01)

(52) U.S. Cl. ..... 440/76; 440/80

(58) Field of Classification Search ..... 440/76, 440/78, 80, 81

See application file for complete search history.

(56) References Cited

U.S. PATENT DOCUMENTS

| | | | | |
|---|---|---|---|---|
| 1,813,552 | A * | 7/1931 | Stechauner | 416/129 |
| 3,589,204 | A * | 6/1971 | Langley | 440/59 |
| 4,529,387 | A * | 7/1985 | Brandt | 440/66 |
| 4,810,218 | A * | 3/1989 | Iwai | 440/66 |
| 5,085,603 | A * | 2/1992 | Haluzak | 440/51 |
| 6,313,136 | B1 | 11/2001 | Amin et al. | |

* cited by examiner

*Primary Examiner*—Sherman Barsinger
(74) *Attorney, Agent, or Firm*—Novak Druce & Quigg, LLP

(57) ABSTRACT

An outboard drive for boats, having a steerable underwater housing (1) which has a wing-profiled portion (2). Projecting at an approximately 90 degree angle from the aft part of one side face (31) of the wing profile is a face portion (32), the lateral extent of which amounts to about 1–2% of its distance to the steering shaft (36) of the wing profile. As a result of this construction, a lifting force will be generated during forward travel in the water. The face portion is configured on that side of the profile which produces a lifting force counter-directional to a steering force, deriving from the motor torque, upon the wing profile.

20 Claims, 1 Drawing Sheet

OUTBOARD DRIVE FOR BOATS

CROSS-REFERENCE TO RELATED APPLICATIONS

The present application is a continuation patent application of International Application No. PCT/SE2004/000600 filed 20 Apr. 2004 now abandoned which is published in English pursuant to Article 21(2) of the Patent Cooperation Treaty, and which claims priority to Swedish Application No. 0301802-5 filed 23 Jun. 2003. Said applications are expressly incorporated herein by reference in their entireties.

TECHNICAL FIELD OF THE INVENTION

The present invention relates to an outboard drive for boats that include an underwater housing which has a wing-profiled portion, having an aft portion configured non-symmetrically with respect to a vertical plane of symmetry of the wing profile. The outboard drive is intended to be mounted in a boat's hull for rotation about a substantially vertical steering shaft and a vertical drive shaft is mounted rotatably in the underwater housing concentrically with the steering shaft. At least one substantially horizontal propeller shaft is included that is rotatably mounted in the underwater housing and which, via a bevel gear encased in the underwater housing, is drivably connected to a lower end of the drive shaft. An upper end of the drive shaft is intended to be connected to a drive unit disposed on the inner side of the boat's hull.

BACKGROUND OF THE INVENTION

To a rotatable underwater housing of an outboard drive for boats, torque is transmitted from the motor coupled to the outboard drive via a bevel gear mounted on the inner side of the boat's hull, so that the underwater housing, under load, strives to rotate in the same direction as the rotational direction of the vertical drive shaft. Outboard drives of the type described above are used, in particular, in boats from 40 feet and upward, which have high-powered motors with high torque, for example from about 600 Nm and above. This means that the underwater housing is constantly subjected, while the boat is in motion, to a relatively high steering torque that somehow has to be balanced.

A simple and known method is, of course, quite simply to dimension the steering machinery of the drive large enough so that it is able to absorb the forces to which the motor torque gives rise, together with the steering forces when the boat yaws. This means, however, that the steering machinery has to be more generously proportioned than would be required if it merely needed to exert the force to rotate the underwater housing during yawing. Another way is to dimension the underwater housing with a very large surface area behind the steering shaft of the underwater housing. Finally, the underwater housing can be configured with an asymmetrical profile, for example with a curved aft part, which is also known.

To provide the drive with steering machinery that is more powerful than that required for the actual steering is an expensive solution. This also applies to an underwater housing having a large surface area.

Moreover, such an underwater housing increases the resistance in the water and is additionally given an unnecessary amount of weight. Also, a drive having a curved aft edge on the wing-shaped underwater housing is more difficult to produce than a symmetrical drive and the dimensional control is not as good.

SUMMARY OF INVENTION

An object of the present invention is to produce an outboard drive of the type introduced above, and which is asymmetrically configured so as to balance the steering force from the motor torque, but in a new way which is easy to control dimensionally and which has an insignificant effect upon production costs compared with a symmetrical drive, while simultaneously resulting in an underwater housing with low drag resistance.

This is achieved according to the invention by virtue of the fact that the wing profile has opposing side faces, of which one face has a first face portion, which extends from the fore edge of the wing profile aftward toward the aft edge of the wing profile, a second face portion, which, with a sharp offset, angles out sideways from the main portion at a distance from the aft edge, and a third face portion, which adjoins the aft edge.

Surprisingly, an angled-out face portion of this kind, which projects sideways by a distance only amounting to one or two percent of the total side face of the wing portion behind the steering shaft, has proved sufficient to balance the steering forces from the motor torque.

BRIEF DESCRIPTION OF THE DRAWINGS

The invention is described in greater detail with reference to illustrative embodiments shown in the accompanying drawings, in which.

DETAILED DESCRIPTION

Figure 1:
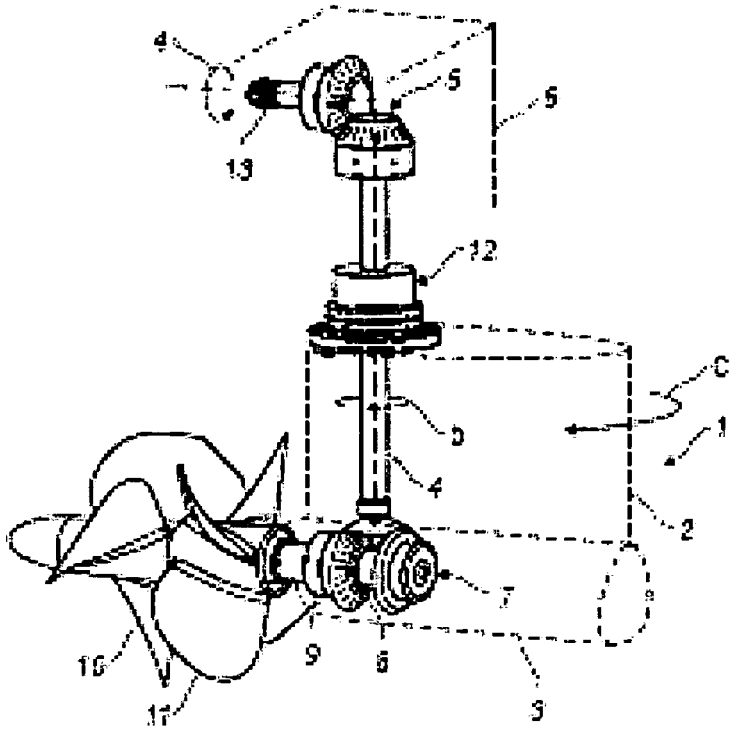
FIG. 1 shows a diagrammatic perspective view of a known outboard drive.

The outboard drive diagrammatically shown in FIG. 1 has an underwater housing 1 having a wing-shaped top part 2 and a torpedo-like bottom part 3. Mounted in the housing 1 is a vertical drive shaft 4, which, via an upper bevel gear 5 in a housing 6 on the inner side of a boat's hull (not shown), can be driven by a motor (not shown). The drive shaft 4 drives, via a bevel gear 7 in the torpedo-like bottom part 3 of the housing 1, two counter-rotating propeller shafts 8 and 9, of which the shaft 9 is a tubular shaft through which the shaft 8 extends. On each of the shafts 8 and 9 is mounted a respective draw propeller 10 and 11.

A bearing housing with steering spindle for pivotal mounting of the underwater housing 1 on the outer side of the bottom of a boat's hull is denoted by 12. Pivoting of the underwater housing is realized with the aid of a steering motor (not shown), which can be electric or hydraulic.

Figure 2:
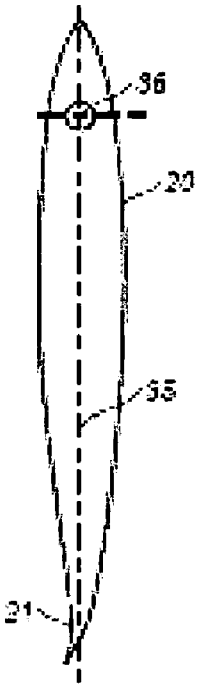
FIG. 2 shows a known asymmetrical cross-sectional profile of the underwater housing for a drive of the type shown in FIG. 1.

When an input shaft 13 is driven in the rotational direction indicated by the arrow "a", the vertical drive shaft 4 is driven, via the bevel gear 5, in the rotational direction indicated by the arrow "b", the torque from the motor giving rise to a steering force upon the underwater housing 1 in the direction indicated by the arrow "c". This steering force can be balanced in a known manner if the wing-shaped housing part 2 is configured asymmetrically, for example with a profile 20 as shown in FIG. 2 and having a slightly curved aft portion 21. A lifting force is thereby created, which is counter-directional to the steering force.

Figure 3A:
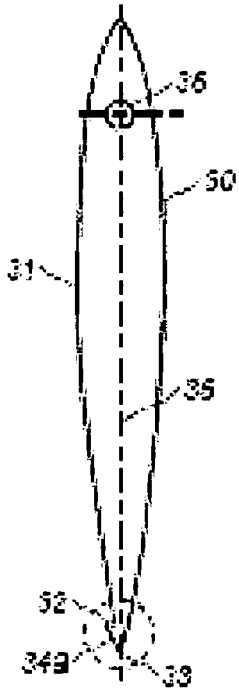
FIG. 3*a* shows a first embodiment of the cross-sectional profile of a drive configured according to the present invention.

According to the present invention, a corresponding lifting force can be produced with a wing-shaped housing part 2, which in one embodiment has the profile 30 shown in FIG. 3*a*. Here, projecting sideways from a main portion 31 of one side face of the profile 30 is a face portion 32, which adjoins the aft edge 33 of the wing profile via a face portion 34*a*. In the illustrated embodiment, the face portion 32 forms an approximately 90 degree angle with the plane of symmetry 35 of the wing profile. A lateral extent amounting to one to two percent of its distance to the steering shaft 36 of the profile has herein proved sufficient to produce the force necessary to balance the steering force from the motor torque. In the illustrated embodiment, this is about one and one-half percent. The distance between the face portion 32 and the aft edge 33 can be between two and six percent of the distance between the steering shaft 36 and the aft edge. In the illustrated embodiment, this is about five percent.

Figure 3B:
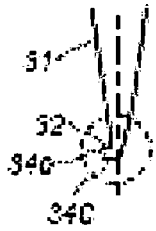
FIG. 3b PRIOR ART
FIG. 3*b* shows a second embodiment of that region of the profile which is ringed in FIG. 3*a*.

FIG. 3*b* shows an alternative embodiment of the aft portion of the wing profile which is ringed in FIG. 3*a*, which embodiment differs from the profile in FIG. 3*a* mainly by virtue of the fact that the face portion 32 adjoins the aft edge 33 via an angled face portion 34*b*, 34*c*. Here, the face portion 32 is situated closer to the aft edge 33 than in the embodiment in FIG. 3*a*. In the embodiment according to FIG. 3*b*, the face portion 32 can be a surface on a separate rail, which, expediently, is fixedly mounted on the aft edge 33 of the wing-shaped top part 2 of the underwater housing.

What is claimed is:

1. An outboard drive for boats, comprising an underwater housing (1) which has a wing-profiled portion (2), having an aft portion configured non-symmetrically with respect to a vertical plane of symmetry (35) of the wing profile, and is intended to be mounted in a boat's hull for rotation about an at least substantially vertical steering shaft (36), a vertical drive shaft (4) mounted rotatably in the underwater housing concentrically with the steering shaft, and at least one at least substantially horizontal propeller shaft (8,9), which is mounted rotatably in the underwater housing and which, via a bevel gear encased in the underwater housing, is drivably connected to a lower end of said drive shaft, the upper end of which is intended to be connected to a drive unit disposed on the inner side of the boat's hull, wherein the wing profile (2) has opposing side faces, of which one face has a first face portion (31), which extends from the fore edge of the wing profile aftward toward the aft edge (33) of the wing profile, a second, essentially flat face portion (32) which, with an abrupt offset, angles out sideways from the first portion at a distance from the aft edge, and a third face portion (34*a*, 34*b*, 34*c*), which adjoins the aft edge.

2. The outboard drive as recited in claim 1, wherein said second face portion (32) forms an approximately 90 degree angle with the plane of symmetry (35) of the wing profile.

3. The outboard drive as recited in claim 1, wherein said second face portion (32) has a width amounting to about 1–2 percent of its distance to the steering shaft (36) of the wing profile.

4. The outboard drive as recited in claim 1, wherein said second face portion (32) has a distance to the aft edge (33) of the wing profile amounting to about 2–6 percent of the distance between the steering shaft (36) and the aft edge.

5. The outboard drive as recited in claim 1, wherein said wing-profiled portion (2) forms an upper part of the underwater housing (1) and adjoins a lower, torpedo-like portion (3) encasing the bevel gear (7).

6. The outboard drive as recited in claim 1, wherein said propeller shaft (8, 9) has an end which projects from the fore end portion of the underwater housing and supports a draw propeller (10, 11).

7. The outboard drive as recited in claim 1, further comprising two concentric propeller shafts (10, 11) mounted in the underwater housing (1) and that are drivably connected to a double bevel gear for driving their respective draw propeller (10, 11) in opposite directions.

8. The outboard drive as recited in claim 1, wherein said steering shaft of the underwater housing (1) is situated at a distance from the fore edge of the wing profile amounting to about 15–20 percent of the total length of the wing profile (30).

9. An outboard drive for boats, comprising:

an underwater housing (1) having a wing-profiled portion (2) that includes an aft portion configured non-symmetrically with respect to a vertical plane of symmetry (35) of the wing-profiled portion (2);

a vertical drive shaft (4) mounted rotatably in the underwater housing concentrically with a steering shaft;

at least one substantially horizontal propeller shaft (8,9) is rotatably mounted in the underwater housing and which, via a bevel gear encased in the underwater housing, is drivably connected to a lower end of said drive shaft, an upper end of said drive shaft is configured to be connected to a drive unit disposed on the inner side of the boat's hull; and said wing-profiled portion (2) comprises opposing side faces, of which one has (i) a first face portion (31) which extends from the fore edge of the wing-profiled portion (2) aftward toward the aft edge (33) thereof, (ii) a second, essentially flat face portion (32) that has an abrupt offset that angles out sideways from the first portion at a distance from the aft edge and (iii) a third face portion (34*a*, 34*b*, 34*c*) which adjoins the aft edge.

10. The outboard drive as recited in claim 9, wherein said second face portion (32) forms an approximately 90 degree angle with the plane of symmetry (35) of the wing profile.

11. The outboard drive as recited in claim 9, wherein said second face portion (32) has a width amounting to about 1–2 percent of its distance to the steering shaft (36) of the wing profile.

12. The outboard drive as recited in claim 9, wherein said second face portion (32) has a distance to the aft edge (33) of the wing profile amounting to about 2–6 percent of the distance between the steering shaft (36) and the aft edge.

13. The outboard drive as recited in claim 9, wherein said wing-profiled portion (2) forms an upper part of the underwater housing (1) and adjoins a lower, torpedo-like portion (3) encasing the bevel gear (7).

14. The outboard drive as recited in claim 9, wherein said propeller shaft (8, 9) has an end which projects from the fore end portion of the underwater housing and supports a draw propeller (10, 11).

15. The outboard drive as recited in claim 9, further comprising two concentric propeller shafts (10, 11) mounted in the underwater housing (1) and that are drivably connected to a double bevel gear for driving their respective draw propeller (10, 11) in opposite directions.

16. The outboard drive as recited in claim 9, wherein said steering shaft of the underwater housing (1) is situated at a distance from the fore edge of the wing profile amounting to about 15–20 percent of the total length of the wing profile (30).

17. An outboard drive for a boat, comprising:

an underwater housing interiorly housing a propeller shaft and at least a portion of a steering shaft and a drive shaft, said housing having a forward winged portion located at least partially ahead of the drive shaft and an aft sharp-angled portion located behind the drive shaft, said forward winged portion being symmetrically configured about a vertical plane of symmetry and said aft sharp-angled portion being non-symmetrically configured about said vertical plane;

a pair of counter-rotating draw propellers, each mounted on a respective propeller shaft at said forward winged portion of said housing and said housing being configured to be mounted to a bottom surface of a boat hull and rotatable about said steering shaft in a configuration in which said propellers are entirely underwater during operation; and said housing having two side surfaces, a first side surface extending from a forward edge of said housing to an aft edge of said housing with a substantially continuous curved shape, and an opposite second side surface having a substantially continuous curved shape extending aft from said forward edge toward said aft edge of said housing until interrupted by an abrupt outward angle presenting an essentially flat face at said aft sharp-angled portion whereby a rotational force is exerted on said underwater housing in a direction counter to a direction of housing rotation induced by action of the drive shaft during operation.

18. The outboard drive as recited in claim 17, wherein a face of said housing forming at least a portion of said sharp-angled portion is oriented at approximately 90 degrees with respect to the vertical plane of symmetry.

19. The outboard drive as recited in claim 18, wherein the face of said housing forming that portion of said sharp-angled portion that is oriented at approximately 90 degrees with respect to the vertical plane of symmetry has a lateral extent of one to two percent of a distance from the face of said housing forming that portion of said sharp-angled portion that is oriented at approximately 90 degrees with respect to the vertical plane of symmetry to said steering shaft.

20. The outboard drive as recited in claim 17, wherein said steering shaft and said drive shaft are concentrically located.

* * * * *